US009431232B2

(12) United States Patent
Watanabe

(10) Patent No.: US 9,431,232 B2
(45) Date of Patent: Aug. 30, 2016

(54) SHORT ARC DISCHARGE LAMP

(71) Applicant: USHIO DENKI KABUSHIKI KAISHA, Tokyo (JP)

(72) Inventor: Tomoki Watanabe, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/260,993

(22) Filed: Apr. 24, 2014

(65) Prior Publication Data

US 2014/0320002 A1 Oct. 30, 2014

(30) Foreign Application Priority Data

Apr. 24, 2013 (JP) ..... 2013-090891
Aug. 9, 2013 (JP) ..... 2013-165831

(51) Int. Cl.
*H01J 17/04* (2012.01)
*H01J 61/04* (2006.01)
*H01J 61/86* (2006.01)
*H01J 61/073* (2006.01)

(52) U.S. Cl.
CPC ..... *H01J 61/86* (2013.01); *H01J 61/0732* (2013.01)

(58) Field of Classification Search
CPC ..... H01J 61/86; H01J 61/0732
See application file for complete search history.

(56) References Cited

U.S. PATENT DOCUMENTS 5,627,430 A * 5/1997 Kira et al. ..... 313/570
6,844,678 B2 * 1/2005 Okanuma ..... H01J 61/0737 313/570
8,390,198 B2 3/2013 Shimizu et al.
2002/0074943 A1 * 6/2002 Mehr ..... H01J 61/073 313/631
2010/0039035 A1 * 2/2010 Kotowicz ..... H01J 61/0732 313/631
2012/0081002 A1 * 4/2012 Arimoto et al. ..... 313/632

FOREIGN PATENT DOCUMENTS

JP S62-241253 A 10/1987
JP 2011-154927 A 8/2011

* cited by examiner

*Primary Examiner* — Donald Raleigh
(74) *Attorney, Agent, or Firm* — Michael Best & Friedrich LLP

(57) ABSTRACT

A cathode for a discharge lamp in which an electron emitting section containing an easily electron emitting material at its end is provided that has simplified yet non-breakable structure and can reduce the manufacturing cost. A short arc discharge lamp includes an arc tube in which a cathode and an anode face each other and a xenon gas is enclosed. The cathode has an electron emitting section made from tungsten to which thorium is added as an easily electron emitting substance. The cathode also has an electrode body section made from tungsten to which no thorium is added. The electrode body section has a recess at a front end side. The electron emitting section has a circular truncated conical shape, a rear end side of the electron emitting section is received in the recess, and a front end side portion protrudes from the recess.

11 Claims, 4 Drawing Sheets

SHORT ARC DISCHARGE LAMP

FIELD OF THE INVENTION

The present invention generally relates to a short arc discharge lamp, and more particularly to a short arc discharge lamp that has a cathode electron emitting section including a cathode which contains an electron emitting substance.

DESCRIPTION OF THE RELATED ART

In general, a short arc discharge lamp in which xenon is enclosed and sealed and which is used as a light source for a cinema projector is a direct current lighting lamp, and a short arc discharge lamp in which mercury is enclosed and sealed and which is used as a light source for semiconductor exposure and LCD (liquid crystal display) exposure is also a direct current lighting lamp.

A typical example of such discharge lamp is illustrated in FIG. 1 of the accompanying drawings. A discharge lamp 100 has an arc tube (in other words, luminous tube or light emitting tube) 60. The arc tube 60 includes a light emission part 40, and sealing parts 50, 50 at opposite ends of the light emission part 40. A cathode 10 and an anode 20 are located in the light emission part 40 such that the cathode 10 faces the anode 20. The discharge lamp 100 emits light upon application of a direct current (DC).

When the discharge lamp emits the light with the direct current, the bright (shining) point of the arc is fixed on the tip of the cathode to create a point light source. Therefore, when the discharge lamp is used in combination with an optical system, it can achieve a highly efficient use of the light.

The cathode used in such DC discharge lamp continuously emits electrons while the lamp is normally lighting. Thus, the cathode is often made from a high-melting-point metal which contains an electron emitting substance (electron emitting material) in order to facilitate the electron emission.

In general, the electron emission substance used for a discharge lamp that is required to provide a point light source and emit light at a high brightness is thorium because thorium admits a high operating temperature at the cathode tip. However, thorium is a radioactive substance and use of thorium is strictly regulated in recent years. If thorium must be used for the cathode, the content of thorium is required to be reduced to the extreme minimum.

In view of these facts, a chip that contains thorium is provided at the cathode tip only, and such cathode structure is often employed to meet the above-described demand.

One example of conventional discharge lamp that has a chip, which contains an electron emission substance, at a cathode tip is disclosed in Japanese Patent Application Laid-Open Publication (Kokai) No. Sho62-241253. In this kind of discharge lamp, a recess having a bottom is formed in an electrode base material, and a chip which contains the electron emitting substance is mechanically buried in the recess by means of, for example, press fit. Another example of discharge lamp is disclosed in Japanese Patent Application Laid-Open Publication No. 2011-154927. In this kind of discharge lamp, the chip which contains the electron emitting substance is attached to the electrode base material by diffusion junction.

The above-described conventional discharge lamps, however, have the following disadvantages.

In the cathode structure of Japanese Patent Application laid-Open Publication No. Sho62-241253, the recess is formed in the electrode base material which is made from a metal having a high melting point, and a sintered body (chip) which contains the electron emitting substance is press fit into the recess. Because the sintered boy has a low density and durability (rigidity) is low, the chip or the electrode base material may be damaged (or broken) upon press fitting. This decreases the yield.

In Japanese Patent Application Laid-Open Publication No. 2011-154927, the electrode base material made from a metal having a high melting point and the sintered boy which contains the electron emitting substance are forced to abut onto each other under pressure at a high temperature, and connected to each other by diffusion junction. The diffusion junction is performed with, for example, a discharge plasma sintering method (SPS sintering method). However, a discharge plasma device is expensive, and a high cost is needed to build a certain size of production facility.

During the manufacturing process, the electrode base material and the sintered body abut against each other and are pressurized. Then, the electrode base material and the sintered body are heated to a predetermined sintering temperature and maintained in this condition for a predetermined period. Accordingly, the manufacturing process requires a large amount of heat and time. As such, if the different materials should be joined to manufacture the cathode, the manufacturing entails various difficulties.

SUMMARY OF THE INVENTION

An object of the present invention is therefore to provide a discharge lamp cathode that has a simple structure, is easy to manufacture, can be manufactured at a lower cost, and is difficult to break. The cathode has an electron emitting section at a tip thereof, and the electron emitting section contains an easy-electron-emission substance (easily electron emitting material).

In order to achieve the above-mentioned object, the present invention provides an improved short arc discharge lamp. According to one aspect of the present invention, there is provided a short arc discharge lamp that includes an arc tube in which a xenon gas is to be enclosed (sealed), a cathode disposed in the arc tube, and an anode disposed in the arc tube. The anode and the cathode face each other in the arc tube. The cathode has an electron emitting section made from tungsten to which thorium is added as an easily electron emitting substance. The cathode also has an electrode body section made from tungsten to which thorium is not added. The electrode body section is provided with a recess portion at a front end side of the electrode body section. The electron emitting section has a circular truncated conical shape. A rear end side of the electron emitting section is received in the recess portion. A front end side of the electron emitting section protrudes from the recess portion.

The electron emitting section may include a tip end face and a first tapered surface portion extending backward from the tip surface end face. The electrode body section may be disposed inside a hypothetical tapered plane elongated from a tapered plane of the first tapered surface portion.

The electrode body section may include a second tapered surface portion. The hypothetical tapered plane elongated from the tapered plane of the first tapered surface section may coincide with a tapered plane of the second tapered surface section.

A tungsten carbide portion may be formed on a surface of a protruding part of the electron emitting section from the recess portion.

The electrode body section may be provided with an annular flat surface portion at an opening surface of the recess portion (around the opening of the recess portion).

A tungsten carbide portion may be formed on a surface of a protruding part of the electron emitting section from the recess portion. An area of a tapered portion B1 and an area of carbide portion B2 satisfy the following formula:

$$0.1 \leq B2/B1 \leq 0.35$$

where B1 is a total surface area of the tip end face of the electron emitting section, a first tapered surface portion extending backward from the tip end face, a first cylindrical lateral surface porting extending backward from the first tapered surface portion of the electron emitting section and protruding from the recess portion, the annular flat surface portion of the electrode body section, and the second tapered surface portion extending backward from the annular flat surface portion, and B2 is a total area of the tungsten carbide portion formed on the electron emitting section.

The electron emitting section may be of a circular truncated conical shape at a front tip thereof. The electron emitting section may have a tip end face portion with a flat surface. The electron emitting section may also have a first tapered surface portion with a tapered surface extending backward from the tip end face portion. The electron emitting section may also have a first cylindrical lateral surface portion extending backward from the first tapered surface portion. The electrode body section may have a second tapered surface portion extending from the annular flat surface portion. The electrode body section may also have a second cylindrical lateral surface portion linearly extending towards the rear end side of the electrode body section. A ratio of b to a, and a ratio of a to c may satisfy the following formulae:

$$0.16 \leq b/a \leq 0.24 \text{ and } a/c \geq 0.39$$

where (a) is a diameter of the first cylindrical lateral surface portion of the electron emitting section, (b) is a width of the annular flat surface portion and (c) is a diameter of the second cylindrical lateral surface portion of the electrode body section.

The rear end of the electron emitting section may be received in the recess portion such that the rear end of the electron emitting section abuts on a bottom surface of the recess portion of the electron body section. An annular gap may be formed between the rear end of the electron emitting section and the electron body section.

According to the present invention, a rear side portion of the electron emitting section of the cathode is received in the recess portion formed in a front end (fore end) portion of the electrode body section (electrode main body). The opening of the recess portion may be surrounded by the annular flat portion having a certain (or constant) width. Thus, the annular holding portion has a certain (or constant) thickness to hold the electron emitting section. Accordingly, it is possible to provide a cathode that has a simple structure, is easy to manufacture, can reduce a manufacturing cost, and is difficult to break.

With the cathode of the present invention, the electrode body section does not shield the light passing outside the first tapered surface portion because the electrode body section may be situated inside the hypothetical tapered plane (umbrella) that extends from the tapered plane (umbrella) of the first tapered surface portion.

According to the present invention, the hypothetical tapered plane (umbrella) extending from the tapered plane (umbrella) defined by the first tapered surface portion may coincide with the tapered plane defined by the second tapered surface portion. Therefore, it is possible to avoid an excessive elevation of the front end temperature and avoid the breakage (or damage) due to a thermal stress In the present invention, the tungsten carbide portion may be formed on a certain area of that surface of the electron emitting section which protrudes from the recess portion. The tungsten carbide portion extends from the position of the annular (circular) flat portion toward the front end of the electron emitting section. Accordingly, the reduction of the easily electron emitting substance (easy-electron-emission substance) contained in the form of oxide is facilitated, and the breakage of the electrode body section is prevented.

In the present invention, a total surface area of the tip end face (front end face) of the electron emitting section, the first tapered surface portion, the first cylindrical lateral surface portion extending backward from the first tapered surface portion and protruding from the recess portion, the annular flat surface portion, and the second tapered surface portion is taken as an area of tapered surface portion (tapered surface portion area) B1. A total surface area of the tungsten carbide portion formed on the electrode emitting section is taken as the carbide area B2. Because the B2/B1 area percentage may be set to 10% or more, the reduction of the easily electron emitting substance (easy-electron-emission substance) added to (contained in) the electron emitting section is sufficiently carried out. This contributes to the extension of the life of a lamp. In addition, because the B2/B1 area percentage may be set to 35% or less, the front end deformation due to the excessive carbon supply is prevented, and blacking of the lamp is prevented.

In the present invention, the front end of the electron emitting section may be shaped like a circular truncated cone, and the electron emitting section may have a tip end face portion with a flat surface (flat front end face at the tip thereof), a first tapered surface portion extending backward from the tip end face (continuous from the tip end face), and a first cylindrical lateral surface portion extending backward from the first tapered surface portion (continuous from the first tapered surface portion (extending backward from the first tapered surface portion). The percentage of the width (b) of the annular flat portion to the diameter (a) of the first cylindrical lateral surface portion of the electron emitting section, i.e., the b/a percentage, is set to 16% or more. Therefore, a stress or load generated due to the thermal expansion difference between the electrode body section and the electron emitting section does not cause the cracking in the electrode body section. By setting the b/a percentage to 24% or less, the relative size of the diameter (a) of the electron emitting section does not decrease, and therefore the feeding of the easily electron emitting substance (easy-electron-emission substance) is not adversely affected.

If the percentage of the diameter (a) of the first cylindrical lateral surface portion of the electron emitting section to the diameter (c) of the second cylindrical lateral surface portion of the electrode body section, i.e., the a/c percentage, is set to 39% or more, in addition to the above-mentioned conditions, the electron emitting section can have a sufficient size relative to the electrode body section. Therefore, the shortage of the positron (positive electron) emission substance supply does not occur.

According to the present invention, the rear end of the electron emitting section may abut on the bottom of the recess portion of the electrode body section in order to enhance (or improve) the heat conduction to the electrode body section from the electron emitting section. Because the electron emitting section is tightly fitted in the electrode body section, a stress (load) may be concentrated on a certain portion of the recess portion due to the thermal expansion difference between the relevant parts (between the electron emitting section and the electrode body section). It is, however, possible to moderate or ease the stress by forming an annular gap between the rear end of the electron emitting section and the electrode body section.

These and other objects, aspects and advantages of the present invention will become apparent to those skilled in the art from the following detailed description when read and understood in conjunction with the appended claims and drawings.

DETAILED DESCRIPTION OF THE INVENTION

First Embodiment

Figure 1:
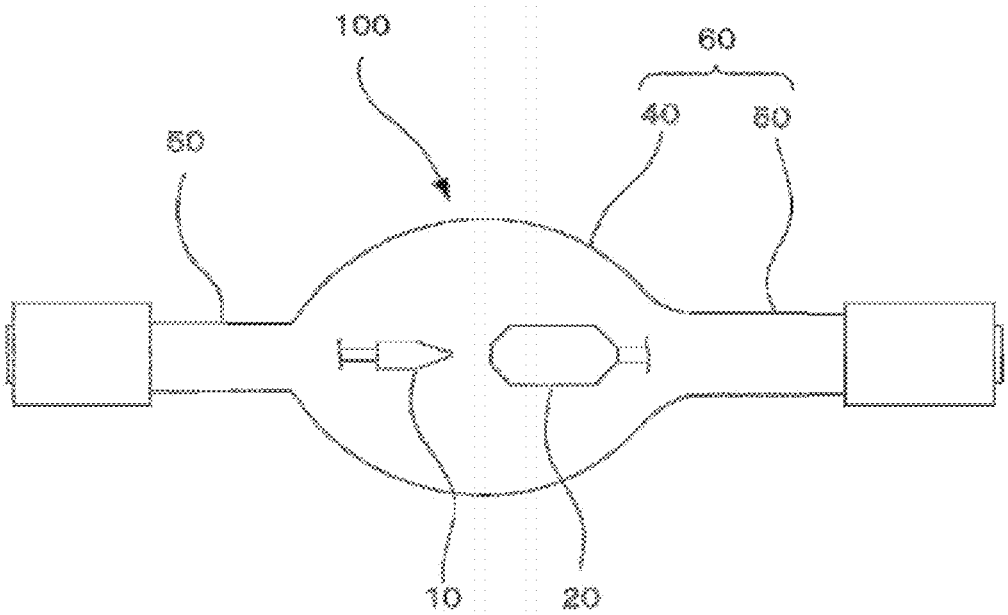
FIG. 1 illustrates a short arc discharge lamp.

Preferred embodiments of the present invention will now be described with reference to the drawings. FIG. 1 illustrates a short arc discharge lamp. The short arc discharge lamp of this embodiment is primarily characterized by a configuration (structure) of a cathode, and other components of the discharge lamp are similar to or the same as those of a common short arc discharge lamp. Accordingly, ordinary components of the short arc discharge lamp will be described with reference to FIG. 1. In the following description, it should be noted that the terms "fore," "front," "back," "rear," "top," "bottom," "side" and the like are used for easier understanding of the illustrated structure of the cathode and the discharge lamp, but these terms are only used for easier understanding and have no intention to limit the scope of the invention.

The discharge lamp 100 has an arc tube 60 that has a light emitting part 40 and sealing parts 50 and 50 at opposite ends of the light emitting part 40. The sealing parts 50 and 50 are components of the arc tube 60. A cathode 10 and an anode 20 are arranged to face each other in the light emitting part 40, and the light emitting part 40 is configured to light upon receiving a direct current.

In the arc tube 60, a noble gas (inert gas) is enclosed (sealed) as a light emitting gas. Alternatively, both a noble gas and mercury may be enclosed (sealed) as a light emitting gas in the arc tube 60. A specific but not limiting example of the noble gas is a xenon gas.

Figure 2:
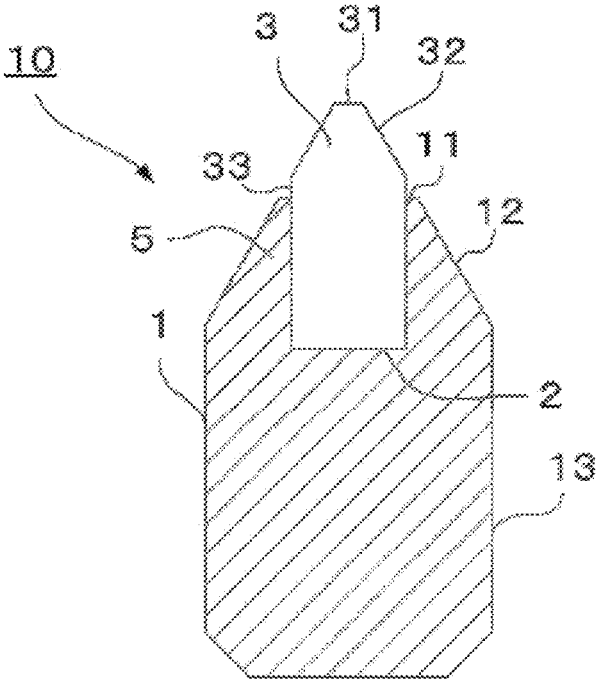
FIG. 2 illustrates a cross-sectional view of a cathode according to a first embodiment of the present invention.

FIG. 2 is a cross-sectional view of a cathode according to the first embodiment of the present invention.

In this drawing, the cathode 10 has an electrode body section (electrode main body) 1, and a recess (recess portion or recess section) 2 is formed in a front (fore) end of the electrode body section 1. A rear end portion of the electron emitting section 3 is received in the recess 2 such that a front portion of the electron emitting section 3 protrudes from the recess 2. The recess 2 has a bottom and is of cylindrical shape.

The electron emitting section 3 is shaped like a circular truncated cone, and has a tip end face 31 of which shape is a flat surface at a tip thereof, a tapered surface portion (i.e., first tapered surface portion) 32 extending backward from the front end face 31, the tapered surface portion being of tapered surface shape, and a cylindrical lateral surface portion (i.e., first cylindrical lateral surface portion) 33 extending backward from the tapered surface portion 32. The tapered surface portion 32 defines an outer tapered surface, and therefore may be referred to as a tapered surface portion. The cylindrical lateral surface portion 33 defines an outer cylindrical side surface, and therefore may be referred to as a cylindrical lateral surface portion.

The electron emitting section 3 is made from a metal having a high melting point, which contains an easily electron emitting substance (i.e., easy-electron-emission substance or emitter) such as thorium. Specifically, the material of the electron emitting section 3 may be tungsten (thoriated tungsten) containing 2 wt % of thorium oxide ($ThO_2$). More specifically, the material of the electron emitting section 3 may be a forged thoriated tungsten having a theoretical density of 90% or more. The theoretical density may be referred to as tungsten filling percentage.

Because the electron emitting section 3 contains the easily electron emitting substance, a work function of the front end face 31 decreases, and the startup or activation of the electron emitting section 3 for lighting becomes easy.

The electrode body section 1 has an annular holding portion 5 around the recess 2 at a front end side of the electrode body section 1. The annular holding portion 5 has a certain thickness. The annular holding portion 5 has an annular flat surface portion 11 at its front end. The annular flat surface portion 11 is formed around the edge (circumference) of the opening of the recess 2. The electrode body section 1 has the tapered surface portion 12 (second tapered surface portion 12) extending backward from the annular flat surface portion 11.

The cylindrical lateral surface portion 13 (second cylindrical lateral face portion 13) extends straight (linearly) backward from the rear end of the tapered surface portion 12.

As described above, the electrode body section 1 possesses a function to hold the electron emitting section 3, and can hold the electron emitting section 3 tightly and rigidly by the annular holding portion 5.

The material of the electrode body section 1 is a metal having a high melting point. Specifically, the material of the electrode body section 1 may be tungsten. In this specification, the term "tungsten" means tungsten to which no thorium is added as the additive. In particular, the pure tungsten having a high purity with no thorium being added is preferred, and the pure tungsten of 99.99% purity or more is more preferred. Similar to the electron emitting section, the theoretical density (i.e., tungsten filling percentage) of this tungsten is equal to or more than 90%.

It should be noted that an easily electron emitting substance, except for thorium which is an easily electron emitting substance having a radioactivity, may be contained in the electrode body section 1 because regulations on the radioactive substances are not applied. An example of the easily electron emitting substance may be an oxide of rare earth metal such as lanthanum and cerium.

Because the electron emitting section and the electrode body section are both high in the density, the electron emitting section 3 may not be damaged or broken even if the electron emitting section 3 is supported by the annular holding portion 5 of the electrode body section 1.

The easily electron emitting substance contained in the electron emitting section 3 is usually a material that has a higher thermal expansion coefficient than a high-melting-point metal such as tungsten. Because of this, the material of the electron emitting section 3 has a greater thermal expansion coefficient than the material of the electrode body section 1.

Thus, a thermal stress is generated between the electron emitting section 3 and the electrode body section 1 at a temperature such as 1,000 degrees C. or higher while the lamp is lighting.

In the cathode 10 of the first embodiment, the electron emitting section 3 is open (exposed) in its front portion, and therefore the thermal stress is generated in the circumferential direction, not in the axial direction. In particular, the thermal stress is generated between the recess 2 of the annular holding portion 5 and the cylindrical lateral surface portion 33.

Accordingly, if the annular holding portion 5 was shaped to have a thin annular flat surface portion 11, the annular holding portion 5 would possess a less durability or rigidity, and would not be able to bear the load generated by the stress. This would result in breakage of the annular holding portion 5.

It is therefore preferred that the annular flat surface portion 11 at the front end of the annular holding portion 5 has a certain width to provide a certain thickness at the front end (fore end side) of the annular holding portion 5.

As described earlier in the first embodiment, a step is formed by the cylindrical lateral surface portion 33 of the electron emitting section 3 and the annular flat surface portion 11 of the electrode body section 1. The annular flat surface portion 11 preferably has a predetermined width to define the step. For example, the width of the annular flat portion 11 may be 0.8 mm to 1.0 mm.

A rear side portion of the electron emitting section 3, which is received in the recess 2 of the electrode body section 1, serves as a storage for the easily electron emitting substance. Specifically, the easily electron emitting substance stored in that portion of the electron emitting section 3 which is present in the recess 2 (i.e., stored in that portion of the electron emitting section 3 which does not protrude from the recess 2) may be gradually supplied to the front portion of the electron emitting section 3 after the easily electron emitting substance contained in the front portion of the electron emitting section 3 evaporates and extinguishes from the front end of the cathode (i.e., when the easily electron emitting substance vanishes from the cathode front end).

Preferably, the electrode body section 1 is present inside (or confined within) a hypothetical tapered plane or umbrella VTF (FIG. 3) that is defined by an elongated plane from the tapered plane defined by the first tapered surface portion 32. In the first embodiment, the term "inside" means the direction toward the center axis of the electrode, and the term "outside" means the direction apart from the center axis of the electrode.

Figure 3:
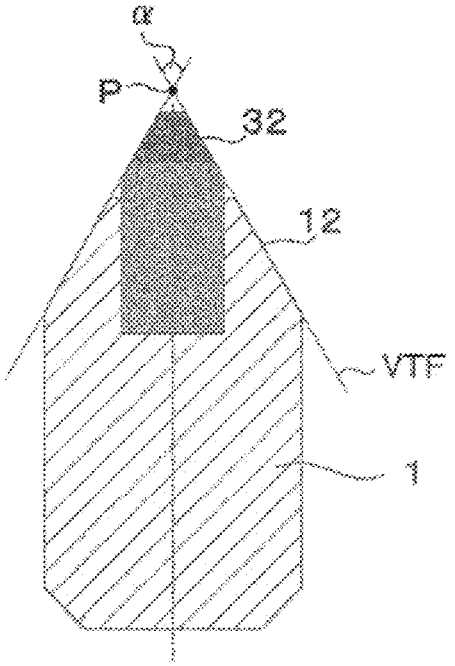
FIG. 3 is a cross-sectional view useful to explain a tapered angle of the cathode shown in FIG. 2.

FIG. 3 shows the tapered angle of the cathode 10 of the first embodiment. The tapered angle α (alpha) of the first tapered surface section 32 is decided in consideration of three points. One point is that the light emitted from the light spot (bright spot) P is not shielded or blocked. Another point is that the electrode body section 1 and/or the electron emitting section 3 can have a certain volume to ensure an appropriate heat capacity. This prevents an excessive temperature elevation of the front end of the electron emitting section 3. Still another point is that the electrode body section 1 is not be damaged or broken by a thermal stress.

If the second tapered surface portion 12 is present outside the hypothetical extension line extending from the first tapered surface portion 32, the light emitted from the light point would be blocked by the second tapered surface portion 12.

To avoid this, the electrode body section 1 (e.g., the second tapered surface portion 12 in FIG. 3) is preferably positioned in the hypothetical tapered plane VTF extending from the tapered plane defined by the first tapered surface portion 32.

With such configuration, the light passing outside the first tapered surface portion 32 is not shielded (blocked) by the second tapered surface portion 12, and can continue to pass.

It is satisfactory for the second tapered surface portion 12 to be inside the extension line extending from the first tapered surface portion 32. However, the electrode body section 1 becomes thinner as the location of the second tapered surface portion 12 is shifted inward. In other words, the volume of the electrode body section 1 decreases and the heat capacity drops as the location of the second tapered surface portion 12 is shifted inward. The decrease of the heat capacity may cause the excessive temperature elevation of the front end portion of the electrode body section 1, and the thermal stress may damage the electrode body section 1.

To avoid this, the taper angle α (alpha) of the first tapered surface portion 32 is preferably equal to the taper angle α (alpha) of the second tapered surface portion 12, and the hypothetical tapered plane VTF extending from the tapered plane defined by the first tapered surface portion 32 preferably coincides with the tapered plane defined by the second tapered surface portion 12. With such configuration, it is possible to prevent the light from being shielded, and also possible to prevent the front end temperature from becoming too high and prevent the damage/breakage due to the thermal stress.

Second Embodiment

Figure 4:
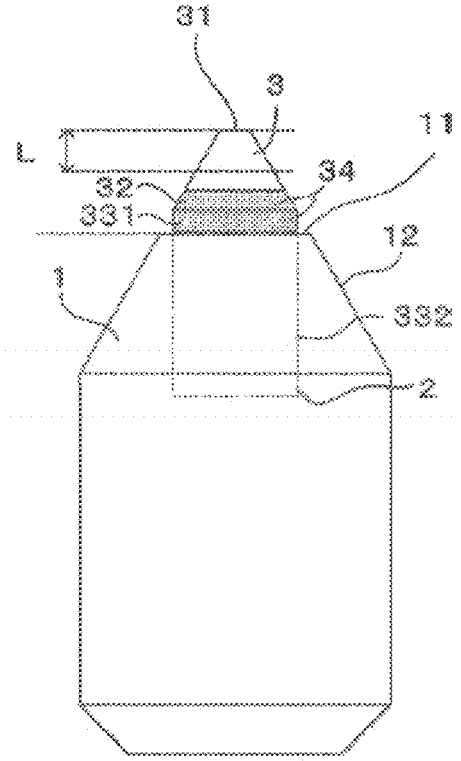
FIG. 4 illustrates a cathode according to a second embodiment of the present invention.

FIG. 4 illustrates a cathode according to a second embodiment of the present invention. The second embodiment is different from the first embodiment in that a tungsten carbide portion (will be described) is provided in the second embodiment. Therefore, the tungsten carbide will be only described in the second embodiment. Other configurations of the cathode of the second embodiment will be not be described because the description of such configuration is already made in the first embodiment. The same reference numerals and symbols are used in the first and second embodiments to designate the same or similar components in the first and second embodiments.

In FIG. 4, a rear area of the exposed surface of the electron emitting section 3 is provided with a tungsten carbide portion 34. The tungsten carbide portion 34 extends forward from the position of the annular flat surface portion 11. Specifically, the surface of the cylindrical lateral surface portion 331 of the electron emitting section 3 which protrudes from the recess 2 and extends forward from the position of the annular flat surface portion 11 is provided with the tungsten carbide portion 34, and the surface in the rear area of the first tapered surface portion 32 is provided with the tungsten carbide portion 34.

The surface of the cylindrical lateral surface portion 332 of the electron emitting section 3 which is received in the recess 2 is not provided with the tungsten carbide portion 34.

The tungsten carbide portion 34 facilitates the reduction of the easily electron emitting substance (easy-electron-emission substance) contained in the electron emitting section 3 in the form of an oxide. In addition, the tungsten carbide portion 34 supplies the tip (front) end face 31 with carbon through a gas phase (or vapor).

It should be noted that in order to prevent an excessive supply of the carbon, the tungsten carbide portion 34 is not provided in, at least, a predetermine region (distance) L that extends backward from the tip end face 31. The vertical length of the predetermined region is L, which may be for example 2 mm to 6 mm.

More particularly, assuming that the easily electron emitting substance is thorium and its oxide is a thorium oxide ($Tho_2$), then a reaction of $Tho_2+2WO_2C \rightarrow Th+4W+2CO$ takes place on the surface of the electron emitting section 3, on which the tungsten carbide portion 34 is formed, under a predetermined temperature condition. This reaction facilitates the reduction of the easily electron emitting substance contained in the form of the oxide, and supplies the tip end face 31 with the carbon through the gas phase (vapor).

If the tungsten carbide portion 34 is formed in a region where no oxide exists, however, the tungsten carbide portion 34 hardly demonstrates the above-mentioned advantages, as understood from the above-indicated formula. Therefore, it is preferred that the tungsten carbide portion 34 is formed in a region in front of the annular flat surface portion 11 to the extent that the oxide is contained (i.e., in the rear area of the exposed part of the electron emitting section 3).

If the tungsten carbide portion is formed on the cylindrical lateral surface portion 332 received in the recess 2, the inner wall of the electrode body section 1 (i.e., the wall of the recess 2) which contacts the tungsten carbide portion is carbonized. This carbonization may decrease the rigidity and cause a breakage of the electrode body section 1. To avoid this, it is preferred that the tungsten carbide portion 34 is not formed on the surface of the cylindrical lateral surface portion 332 received in the recess 2.

Referring to FIGS. 5A to 5F, a method of manufacturing the cathode will be described.

Figure 5A:
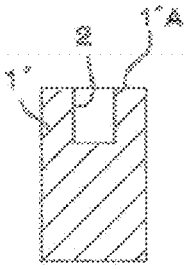
FIG. 5A to FIG. 5F are a series of views to illustrate a method of manufacturing a cathode according to an exemplary embodiment of the present invention.

In FIG. 5A, a cylindrical electrode base material 1', which will ultimately become the electrode body section 1, is made from a metal having a high melting point, preferably tungsten, particularly preferably a highly pure tungsten with no additives contained, and more preferably a pure tungsten with the purity of 99.99% or more.

The recess 2 is formed in the center of the tip end face 1'A of the base material 1'. The recess 2 extends in the axial direction of the base material 1' and has a circular cross sectional shape. The recess 2 has a bottom. For example, the base material 1' may have a diameter of ϕ12 mm, and a length of 25 mm.

The diameter of the recess 2 may be 4-12 micrometers (μm) smaller than ϕ6 mm. The depth of the recess 2 may be 4 mm.

Figure 5B:
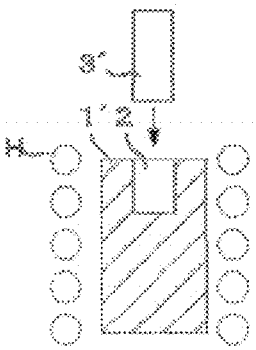

As shown in FIG. 5B, the base material 1' is placed in an electric furnace such that the opening of the recess 2 faces upward. The base material 1' is heated to about 600 degrees C. by a heater H.

In the meantime, a chip 3' that contains an electron emitting substance is prepared, and inserted into the recess 2 of the base material 1' which has been heated and thermally expanded.

The chip 3' is a metal having a high melting point, to which the electron emitting substance is added. Specifically, the chip 3' may be a thoriated tungsten having a theoretical density of 90% or more. 2 wt % of thorium oxide ($ThO_2$) is added to tungsten to obtain the thoriated tungsten.

The diameter of the chip 3' is ϕ6 mm, and the length of the chip 3' is 14 mm. Preferably, the diameter of the chip 3' is 4-12 micrometers (μm) larger than the diameter of the recess 2 at room temperature. The length of the chip 3' is larger than the depth (4 mm) of the recess 2, and therefore the front end of the chip 3' protrudes from the recess 2 when the chip 3' is received in the recess 2.

Figure 5C:
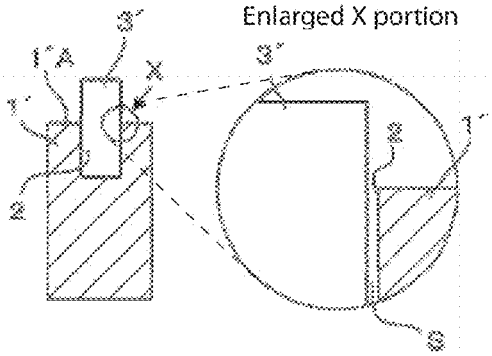

As shown in FIG. 5C, the chip 3' is inserted into the recess 2 of the heated base material 1'. When the bottom of the chip 3' reaches the bottom of the recess 2, the front portion of the chip 3' protrudes from the front end face 1' A of the base material 1'.

When the chip 3' is inserted into the base material 1', the base material 1' is already heated and thermally expanded. As shown in the enlarged view of the part X, therefore, there is a certain gap S between the chip 3' and the recess 2. Accordingly, press-fitting is not necessary to insert the chip 3' into the recess 2, and the chip 3' can easily be inserted into the recess 2.

Subsequently, the electric furnace is deactivated and the base material 1' is cooled to room temperature.

Figure 5D:
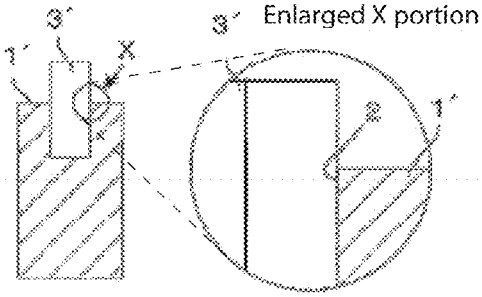

As shown in FIG. 5D, the base material 1' shrinks upon this cooling. As shown in the enlarged view of the part X in this drawing, the recess 2 of the base material 1' tightly fits the chip 3' and there is no gap between the recess 2 and the chip 3'. As such, the base material 1' and the chip 3' are fixedly engaged with each other.

Figure 5E:
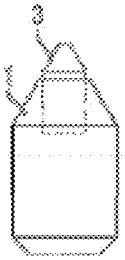

Then, as shown in FIG. 5E, the front end portion of the base material 1' and the front end portion of the chip 3' are tapered by machining (cutting).

The machining of the chip 3' is performed such that the tip end face 31 remains at the tip (front end) of the electron emitting section 3. Preferably, the machining of the base material 1' is performed such that the annular flat surface portion 11 remains. Therefore, the thickness of the base material 1' around the opening of the recess 2 to receive the chip 3' does not become too small. In other words, the base material 1' around the opening of the recess 2 can have a certain thickness to stably hold the electron emitting section 3.

Figure 5F:
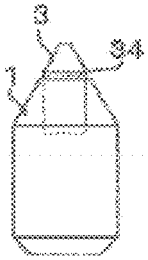

When the cathode shown in FIG. 4 is manufactured, the tungsten carbide portion 34 is formed at a predetermined position as shown in FIG. 5F. Carbon is mixed with a binder such as an organic solvent, and this mixture of carbon and binder is applied onto the cathode surface by a brush or the like. The mixture is then sintered to obtain the tungsten carbide portion 34.

As described above, the cathode for a discharge lamp of the present embodiment has a simple structure, and can be manufactured with less manufacturing steps. No special equipment is necessary for the manufacture of the cathode. Thus, it is possible to reduce the manufacturing cost.

Because the chip 3' (electron emitting section) is tightly fitted in the recess 2 of the electrode body section 1 by shrinkage of the recess 2 upon cooling, the chip 3' receives the pressure from its surrounding in all the directions. Thus, even if a stress is generated between the electron emitting section 3 and the electrode body section 1, a mechanical breakage can be avoided.

Figure 6:
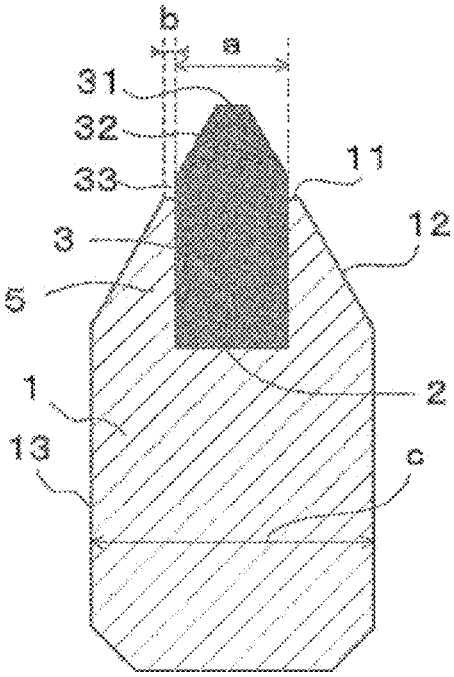
FIG. 6 is a cross-sectional view useful to explain an annular flat surface portion according to an exemplary embodiment of the present invention.

Referring now to FIG. 6, the diameter of the electron emitting section 3 and the width of the annular flat surface portion 11 will be described. The tip (front) portion of the electron emitting section 3 has a circular truncated cone shape.

The electron emitting section 3 possesses the tip (front) end face 31 of which shape is a flat surface at a tip thereof, a tapered surface portion 32 (i.e., first tapered surface portion 32) extending backward from the tip end face 31, and a cylindrical lateral surface portion 33 (i.e., first cylindrical surface portion 33) extending backward from the tapered surface portion 32. The tapered surface portion 32 defines an outer tapered surface, and the cylindrical lateral surface portion 33 defines an outer cylindrical side surface. The electrode body section 1 has the annular holding portion 5 around the recess 2 at a front end of the electrode body section 1. The annular holding portion 5 has a certain thickness. The annular holding portion 5 has the annular flat surface portion 11 at its front end. The annular flat surface portion 11 is formed around the edge of the opening of the recess 2. The electrode body section 1 has the tapered surface portion 12 (second tapered surface portion 12) extending backward from the annular flat surface portion 11. The cylindrical lateral surface portion 13 (second cylindrical lateral surface portion 13) extends straight or linearly backward from the rear end of the tapered surface portion 12. Preferably the width of the annular flat surface portion 11 may be altered to a suitable value depending upon the size of the diameter of the cylindrical lateral surface portion 33 of the electron emitting section 3. Specifically, it is preferred that the diameter a of the cylindrical lateral surface portion 33, the width b of the annular flat surface portion 11 and the diameter c of the cylindrical lateral surface portion 13 of the electrode body section 1 satisfy the following conditions: $0.16 \leq b/a \leq 0.24$ and $a/c \geq 0.39$.

For example, if the percentage of the width b of the annular flat surface portion 11 to the diameter a of the cylindrical lateral surface portion 33 of the electron emitting section 3 (i.e., the b/a percentage) is set to 16% or more, the annular flat surface portion 11 can have a sufficient width b so that it has an enhanced rigidity and no cracking would be generated by a stress or load derived from the thermal expansion difference between the electron emitting section and the electrode body section. If the b/a percentage is 24% or less, the electron emitting section 3 would not become too small relative to the electrode body section 1, and the life of the lamp would not be adversely affected. In addition, if the a/c percentage (i.e., the percentage of the diameter a of the cylindrical lateral surface portion 33 of the electron emitting section 3 to the diameter c of the cylindrical lateral surface portion 13 of the electrode body section 1) is 39% or more, the electron emitting section 3 can have a sufficient size relative to the electrode body section 1 so that it is possible to feed a sufficient amount of positron emission substance and the life of the lamp would not be deteriorated.

TABLE 1

| Sample | S1 | S2 | S3 | S4 | S5 | S6 | S7 | S8 | S9 |
|---|---|---|---|---|---|---|---|---|---|
| a (mm) | 4.0 | 4.0 | 4.9 | 5.9 | 4.9 | 4.0 | 3.9 | 4.9 | 4.0 |
| b (mm) | 0.35 | 0.50 | 0.76 | 1.03 | 0.96 | 0.82 | 0.93 | 1.31 | 1.99 |
| c (mm) | 12 | 12 | 10 | 12 | 10 | 12 | 10 | 10 | 12 |
| Rate1 (b/a) | 0.09 | 0.13 | 0.16 | 0.17 | 0.20 | 0.21 | 0.24 | 0.27 | 0.50 |
| Rate2 (a/c) | 0.33 | 0.33 | 0.49 | 0.49 | 0.49 | 0.33 | 0.39 | 0.49 | 0.33 |
| Cracking Evaluation | X | X | ○ | ○ | ○ | ○ | ○ | ○ | ○ |
| Durability Evaluation | X | X | ○ | ○ | ○ | X | ○ | X | X |

Table 1 shows the comparison of nine samples, with the ratio of the width b of the annular flat surface portion 11 to the diameter a of the cylindrical lateral surface portion 33 of the electron emitting section 3 being changed and the ratio of the diameter a of the cylindrical lateral surface portion 33 of the electron emitting section 3 to the diameter c of the electrode body section 1 being changed. In Table 1, the evaluation results of the samples S1, S2, S4, S6 and S9 were obtained when the lamps lit continuously at 7,000 W, and the evaluation results of the samples S3, S5, S7 and S8 were obtained when the lamps lit continuously at 4,000 W. With respect to the evaluation of cracking, if there was cracking in the electrode body section after lighting, the sample was given the no good mark "X." With respect to the evaluation of durability, if the flickering occurred within 500 hours, the sample was given the no good mark "X."

As shown in Table 1, when the b/a percentage is 16% or more, the annular flat surface portion 11 can have a sufficient width b. Therefore, no cracking occurs in the electrode body section 1 even if a stress is generated due to the expansion of the electron emitting section. When the b/a percentage exceeds 24%, the annular flat surface portion 11 has a too large width b, and therefore the electron emitting section 3 becomes relatively small. As a result, the relative amount of the easily electron emitting substance contained in the electron emitting section 3 decreases. The easily electron emitting substance depletes earlier in the electron emitting section, and the startup for lighting becomes difficult. In view of this, the b/a percentage is preferably 24% or less.

Figure 7:
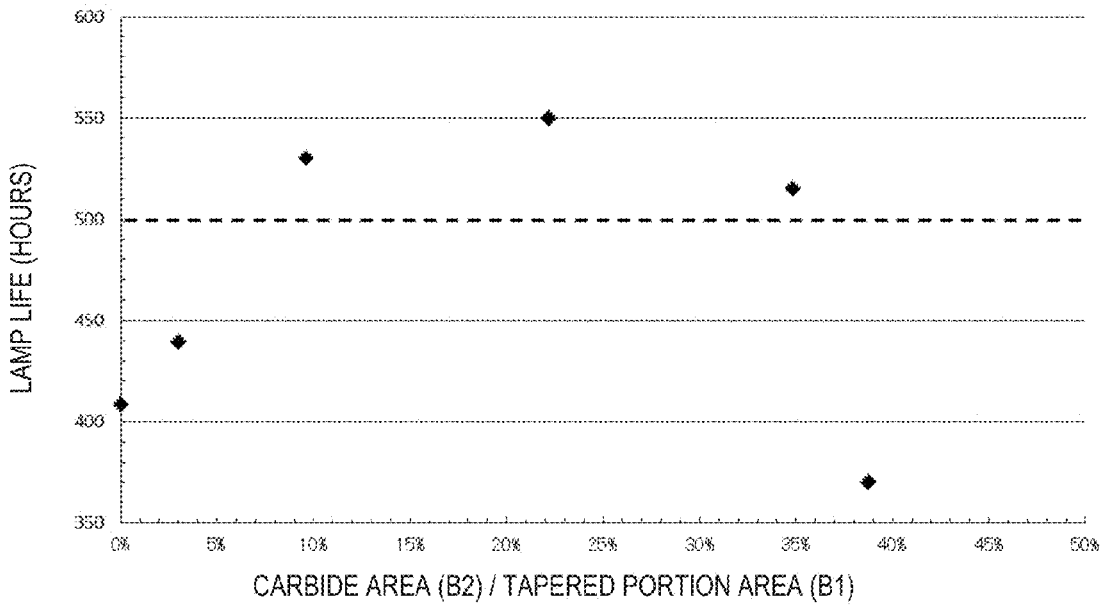
FIG. 7 illustrates relationship between a carbide (carbonized) area and a life of lamp according to the present invention.

FIG. 7 shows the relationship between the tungsten carbide area formed on the electron emitting section 3 and the life of the lamp. The tapered surface area B1 is a total surface area of the tip end face 31 of the electron emitting section 3, the first tapered surface portion 32 extending backward from the tip end face 31, the cylindrical lateral surface portion 331 extending backward from the first tapered surface portion 32 and protruding from the recess 2, the annular flat surface portion 11 of the electrode body section 1, and the second tapered surface portion 12 extending backward from the annular flat surface portion 11. The carbide area (carbonized area) B2 is a total surface area of the tungsten carbide portion 34. In FIG. 7, the broken line indicates an average life of a conventional lamp that has a cathode made from the thoriated tungsten only.

As shown in FIG. 7, the size of the carbide area B2 relative to the tapered portion area B1 (i.e., the B2/B1 percentage) is preferably 10% or more. This is because the life of the lamp elongates significantly when the B2/B1 area percentage is 10% and a relative long life is imparted to the lamp when the B2/B1 area percentage is over 10%. When the B2/B1 percentage is 10% or more, it is also observed that the life of the lamp is longer than 500 hours. 500 hours is the average life of the conventional lamp. It should be noted, however, that if the carbide area B2 becomes too large, carbon is supplied excessively and the electron emitting section 3 may have a distorted shape. This may cause the flickering and reduce the life of the lamp. To avoid this, the upper limit of the B2/B1 percentage is preferably 35% or less. In view of the above-described consideration, the B2/B1 percentage preferably satisfies the following condition: $0.1 \leq B2/B1 \leq 0.35$.

Third Embodiment

Figure 8:
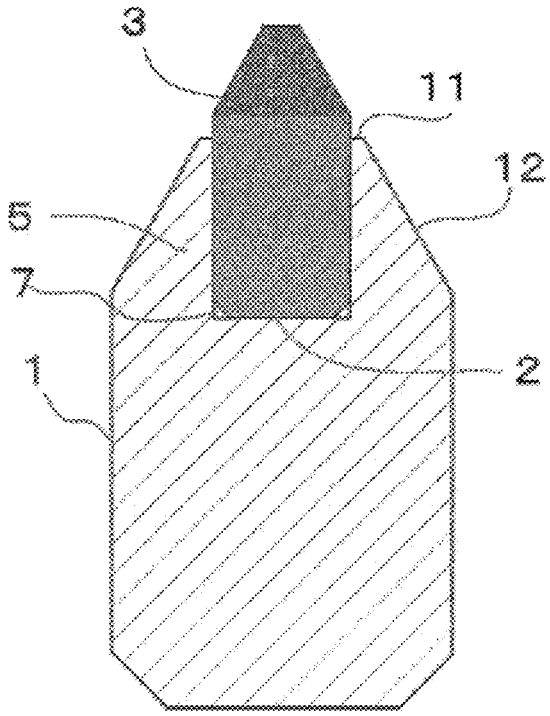
FIG. 8 illustrates a cathode according to a third embodiment of the present invention.

FIG. 8 illustrates a cathode according to a third embodiment of the present invention. The third embodiment is different from the first embodiment in that there is an annular gap (space) 7 between the rear end of the electron emitting section 3 and the electrode body section 1. In the following description, the same reference numerals are used to designate the same or similar elements in the first and third embodiments and such elements will not be described.

As shown in FIG. 8, the recess 2 is formed in the front portion of the electrode body section 1, and the electron emitting section 3 is received in the recess 2. The recess 2 has a cylindrical shape, and possesses a bottom. The front portion of the electron emitting section 3 protrudes from the recess 2, and the rear portion of the electron emitting section 3 is firmly received in the recess 2. The rear end face of the electron emitting section 3 generally abuts on the bottom of the recess 2, with the annular gap 7 being left between the periphery of the rear end face of the electron emitting section 3 and the recess 2 of the electrode body section 1. This annular gap 7 is formed between the electron emitting section 3 and the electrode body section 1 when the electron emitting section 3 is firmly fitted in the recess 2 of the electrode body section 1.

In order to form the annular gap 7, the periphery of the rear end face of the electron emitting section 3 may be chamfered beforehand. Alternatively, a groove may be formed in the bottom of the recess 2 of the electrode body section 1 beforehand. The chamfered portion or the groove can define the annular gap 7 in the electrode when the electron emitting section 3 is received in the electrode body section 1.

The rear end of the electron emitting section 3 abuts on the bottom of the recess 2 of the electrode body section 1 in order to enhance the thermal conduction to the electrode body section 1 from the electron emitting section 3. Although the electron emitting section 3 is firmly fitted in the electrode body section 1 and a stress or load, which is generated due to the thermal expansion difference between the electron emitting section 3 and the electrode body section 1, concentrates on the bottom corner of the recess 2, the stress may be moderated if the bottom corner of the recess 2 is rounded and the rear end face of the electron emitting section 3 is cut such that the rear end face of the electron emitting section 3 does not contact the rounded bottom corner of the recess 2. The annular gap 7 is formed between the rear end of the electron emitting section 3 and the electrode body section 1. The size of the annular gap 7 is, for example, between approximately 10 micrometer square ($\mu m^2$) and approximately 45 micrometer square ($\mu m^2$), if viewed in a cross section.

While certain embodiments have been described, these embodiments have been presented by way of example only, and are not intended to limit the scope of the present invention. The novel apparatuses (devices) and methods thereof described herein may be embodied in a variety of other forms; furthermore, various omissions, substitutions and changes in the form of the apparatuses (devices) and methods thereof described herein may be made without departing from the gist of the present invention. The accompanying claims and their equivalents are intended to cover such forms or modifications as would fall within the scope and gist of the present invention. The present application is based upon and claims the benefit of a priority from Japanese Patent Application No. 2013-90891, filed Apr. 24, 2013 and a priority from Japanese Patent Application No. 2013-165831, filed Aug. 9, 2013, and the entire contents of these two Japanese Patent Applications are incorporated herein by reference.

What is claimed is:

1. A short arc discharge lamp comprising:

an arc tube configured to enclose a light emitting gas;

a cathode disposed in the arc tube; and an anode disposed in the arc tube such that the anode and the cathode face each other in the arc tube, the cathode comprising an electron emitting section made from tungsten to which thorium is added, and an electrode body section made from tungsten to which thorium is not added, the electrode body section being provided with a recess portion at a front end side of the electrode body section, and the electron emitting section having a circular truncated conical shape, a rear end side of the electron emitting section being received in the recess portion and a front end side of the electron emitting section protruding from the recess portion, wherein the electrode body section is provided with an annular flat surface portion at an opening surface of the recess portion, and a step is formed by the annular flat surface portion and the electron emitting section;

wherein a percentage of a width of the annular flat surface portion to a diameter of a cylindrical lateral surface portion of the electron emitting section is set to 16% or more.

2. The short arc discharge lamp according to claim 1, wherein the electron emitting section includes a tip end face and a first tapered surface portion extending backward from the tip end face, and the electrode body section is disposed inside a hypothetical tapered plane elongated from a tapered plane of the first tapered surface portion.

3. The short arc discharge lamp according to claim 2, wherein the electrode body section includes a second tapered surface portion, and the hypothetical tapered plane elongated from the tapered plane of the first tapered surface portion coincides with a tapered plane of the second tapered surface portion.

4. The short arc discharge lamp according to claim 1, wherein a tungsten carbide portion is formed on a surface of protruding part of the electron emitting section from the recess portion.

5. The short arc discharge lamp according to claim 1, wherein the electrode body section is provided with an annular flat surface portion at an opening surface of the recess portion.

6. The short arc discharge lamp according to claim 5, wherein a tungsten carbide portion is formed on a surface of protruding part of the electron emitting section from the recess portion, and an area of a tapered section B1 and an area of carbide section B2 satisfy the following formula:

$$0.1 \leq B2/B1 \leq 0.35$$

where B1 is a total surface area of a tip end face of the electron emitting section, a first tapered surface portion extending backward from the tip end face, a first cylindrical lateral surface portion extending backward from the first tapered surface portion of the electron emitting section and protruding from the recess portion, the annular flat surface portion of the electrode body section, and a second tapered surface portion extending backward from the annular flat surface portion, and B2 is a total area of the tungsten carbide portion formed on the electron emitting section.

7. The short arc discharge lamp according to claim 5, wherein the electron emitting section is of a circular truncated conical shape at a front tip thereof, and comprises a tip end face portion with a flat surface, a first tapered surface portion with a tapered surface extending backward from the tip end face portion, and a first cylindrical lateral surface portion extending backward from the first tapered surface portion, the electrode body section comprises a second tapered surface portion extending from the annular flat surface portion, and a second cylindrical lateral surface portion linearly extending towards the rear end side of the electrode body section, and a ratio of b to a and a ratio of a to c satisfy the following formulae:

$$0.16 \leq b/a \leq 0.24 \text{ and } a/c \geq 0.39$$

where a is a diameter of the first cylindrical lateral surface portion of the electron emitting section, b is a width of the annular flat surface portion and c is a diameter of the second cylindrical lateral surface portion of the electrode body section.

8. The short arc discharge lamp according to claim 1, wherein a rear end of the electron emitting section is received in the recess portion such that the rear end of the electron emitting section abuts on a bottom surface of the recess portion of the electron body section, and an annular gap is formed between the rear end of the electron emitting section and the electron body section.

9. A short arc discharge lamp comprising:

an arc tube configured to enclose a light emitting gas;

a cathode disposed in the arc tube; and an anode disposed in the arc tube such that the anode and the cathode face each other in the arc tube, the cathode comprising an electron emitting section made from tungsten to which thorium is added, and an electrode body section made from tungsten to which thorium is not added, the electrode body section being provided with a recess portion at a front end side of the electrode body section, and the electron emitting section having a circular truncated conical shape, a rear end side of the electron emitting section being received in the recess portion and a front end side of the electron emitting section protruding from the recess portion, and the material of the electron emitting section having a theoretical density of tungsten filling percentage of 90% of more, wherein the electrode body section is provided with an annular flat surface portion at an opening surface of the recess portion, and a step is formed by the annular flat surface portion and the electron emitting section, wherein a percentage of a width of the annular flat surface portion to a diameter of a cylindrical lateral surface portion of the electron emitting section is set to 16% or more.

10. The short arc discharge lamp according to claim 1, wherein the step is formed by the annular flat surface portion and a cylindrical lateral surface portion of the electron emitting section.

11. The short arc discharge lamp according to claim 9, wherein the step is formed by the annular flat surface portion and a cylindrical lateral surface portion of the electron emitting section.

* * * * *